United States Patent [19]

Kruger

[11] Patent Number: 4,739,737

[45] Date of Patent: Apr. 26, 1988

[54] ROTARY VALVE FOR CONTROL OF THE CYLINDER CHARGE CHANGE OF AN INTERNAL COMBUSTION ENGINE

[75] Inventor: Hermann Kruger, Wolfsburg, Fed. Rep. of Germany

[73] Assignee: Volkswagen AG, Wolfsburg, Fed. Rep. of Germany

[21] Appl. No.: 86,098

[22] Filed: Aug. 14, 1987

[30] Foreign Application Priority Data

Sep. 3, 1986 [DE] Fed. Rep. of Germany ..... 3629969

[51] Int. Cl.[4] ..... F01L 7/02

[52] U.S. Cl. ..... 123/190 A; 123/190 R; 123/80 R

[58] Field of Search ..... 123/190 A, 190 R, 190 B, 123/190 BA, 190 BD, 80 R, 80 BA

[56] References Cited

U.S. PATENT DOCUMENTS

| | | | |
|---|---|---|---|
| 994,541 | 6/1911 | Shakley | 123/190 A |
| 1,113,374 | 10/1914 | Schneider | 123/190 A |
| 1,245,257 | 11/1917 | Miller et al. | 123/190 A |
| 1,273,433 | 7/1918 | Wehr | 123/190 A |
| 1,596,069 | 8/1926 | Skiles | 123/80 BA |
| 1,625,307 | 4/1927 | Frazier | 123/80 BA |
| 1,702,816 | 2/1929 | Danford | 123/190 A |
| 1,740,758 | 12/1929 | White | 123/190 A |
| 4,473,041 | 9/1984 | Lyons et al. | 123/80 BA |
| 4,517,938 | 5/1985 | Kruger | 123/190 BA |

FOREIGN PATENT DOCUMENTS

| | | | |
|---|---|---|---|
| 820512 | 11/1951 | Fed. Rep. of Germany | 123/190 A |
| 964430 | 8/1950 | France | 123/190 A |

*Primary Examiner*—Ira S. Lazarus

*Attorney, Agent, or Firm*—Brumbaugh, Graves, Donohue & Raymond

[57] ABSTRACT

In order to produce a rotary valve with short and small cross-sectional dimensions, fresh gas or exhaust gas ducts of the rotary valve are associated with adjacent cylinders and extend in some regions in a common cross-sectional plane, in different halves of the cross section of the rotary valve outside the longitudinal axis thereof, the plane also contains two diametrically opposite fresh gas and, respectively, exhaust gas openings in the rotary valve housing.

3 Claims, 1 Drawing Sheet

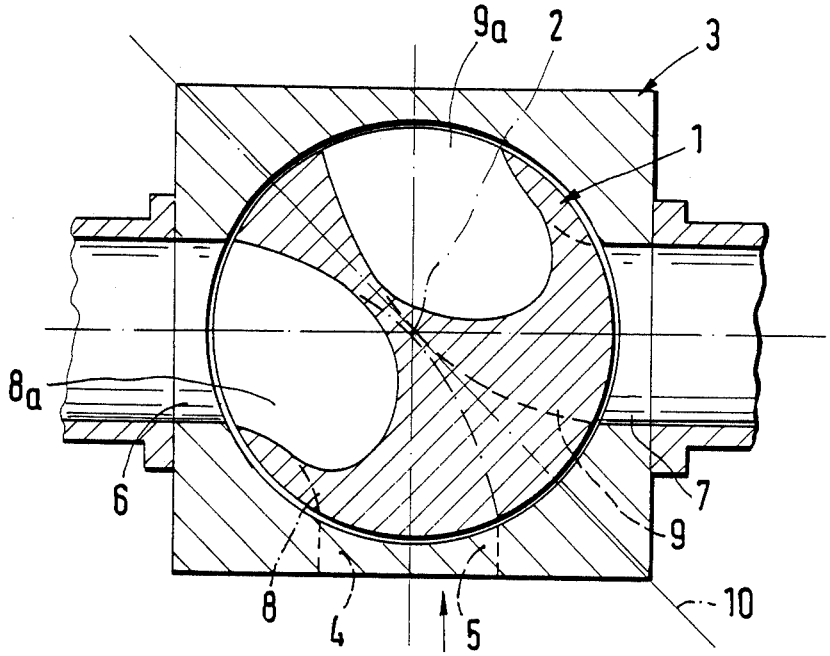
9a
2
3
1
8a
6
7
9
8
4
5
10

ROTARY VALVE FOR CONTROL OF THE CYLINDER CHARGE CHANGE OF AN INTERNAL COMBUSTION ENGINE

BACKGROUND OF THE INVENTION

The invention concerns a rotary valve for control of a cylinder charge change of an internal combustion engine containing a plurality of combustion chambers, whereby two fresh gas or exhaust gas ducts, associated in each case with adjacent combustion chambers, for the purpose of connection with a fresh gas and, respectively, exhaust gas opening in the rotary valve, extend as regards their region in a common cross-sectional plane of the rotary valve.

In a rotary valve of like construction known from DE-OS No. 3,241,723, the exhaust gas ducts associated with adjacent cylinders have regions which extend in a cross-sectional plane located between the cylinders and which are provided with angularly offset mouth points on the periphery of the rotary valve. Depending on the prevailing angular position of the rotary valve, no mouth point or one mouth point will be located below the exhaust gas opening common to both exhaust gas ducts in the rotary valve housing. The exhaust gas opening is in communication with a known exhaust gas system of the internal combustion engine. Taking into account in particular the fact that ducts for fresh gas delivery must also be accommodated in the rotary valve, the course of the exhaust gas ducts and the position of the aforementioned mouth points in a common cross-sectional plane as described offer advantages regarding the attainment of a short axial dimension of the rotary valve.

On the other hand, the aforedescribed configuration of the rotary valve requires a relatively large diameter thereof inasmuch as the flow cross sections of the exhaust gas ducts in the rotary valve cannot be rendered indefinitely small. A large rotary valve diameter, however, suffers from the shortcoming that it results in a high sliding speed of the seals sliding on the valve periphery so that friction, frictional heat, wear and the driving torque of the cylindrical slide valve likewise become relatively large. Moreover, attention must be paid to a defined gap volume between the rotary valve and its housing as well as to sufficient heat transmission surfaces in the ducts.

SUMMARY OF THE INVENTION

Accordingly, it is an object of the present invention to provide a rotary valve of the above-mentioned type wherein the rotary valve housing is provided with two fresh gas and, respectively, exhaust gas openings in the common cross-sectional plane which face each other and are each associated with one of the fresh gas and, respectively, exhaust gas ducts which in the cross-sectional plane extend on different sides of a longitudinal center plane of the rotary valve.

Providing two fresh gas and, respectively, exhaust gas openings facing each other diametrically in the rotary valve housing facilitates the arrangement of the duct regions located in the common cross-sectional plane in different cross-sectional halves, as it were, of the rotary valve.

BRIEF DESCRIPTION OF THE DRAWING

The single figure illustrates an embodiment of a rotary valve pursuant to the present invention.

DETAILED DESCRIPTION OF THE PREFERRED EMBODIMENTS

As can be seen from the drawing, a cylindrical rotary valve 1 rotates in a manner known in itself around its axis 2 in a rotary valve housing 3. The rotary valve housing 3 contains two exhaust gas bores 4 and 5 of which the former bore is placed in front of the drawing plane while the latter bore is placed behind said plane. Thus, the bores 4, 5 overlap in the axial direction. Each of the bores leads to a cylinder whose plane of separation coincides with the common cross-sectional plane and thus the drawing plane. The cylinder below the bore 4 thus extends in front of the drawing plane while the cylinder connected with the bore 5 is placed behind said plane.

The rotary valve housing 3 is provided with two exhaust gas openings 6 and 7 which are facing each other diametrically relative to the axis of rotation 2. The exhaust gas openings 6, 7 lead to a known and therefore not represented exhaust gas system of the internal combustion engine. During predefined angular positions of the rotary valve 1 exhaust gas ducts 8 and 9 produce therein flow communications for the exhaust gas, namely, via the bore 4 to the exhaust gas opening 6 and, respectively, via the bore 5 to the exhaust gas opening 7. In the angular position of the rotary valve 1 shown in the drawing, it has been assumed that the duct 8 connects the front cylinder associated with the bore 4 with the exhaust gas opening 6 and thereby with the exhaust gas system. On clockwise rotation by 90° from the position shown in the drawing, the cylinder located behind the plane of the drawing is in communication by way of the exhaust gas bore 5 and its exhaust gas duct 9 with the exhaust gas opening 7 and thereby with the exhaust gas system.

As shown by the drawing, the ducts 8 and 9 are provided in their common plane with duct regions 8A and 9A extending side by side which, for minimizing the cross section of the rotary valve 1, extend on different sides of the longitudinal center plane 10 and thus in different half-cross sections of the rotary valve 1. Inasmuch as both ducts 8 and 9 extend, at least in this common cross-sectional plane, only over different half-cross sections and thus, outside the region of the rotary valve axis 2, it becomes relatively simple to accommodate the duct cross sections in cylindrical rotary valves with small cross sections, too.

It is obvious that fresh gas ducts can be rendered correspondingly.

While the invention has been illustrated and described as embodied in a rotary valve for control of the cylinder charge change of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A rotary valve for control of a cylinder charge change of an internal combustion engine having a plurality of combustion chambers, the rotary valve comprising: two gas ducts associated with adjacent combustion chambers, said gas ducts being provided so as to extend in a common cross-sectional plane of the rotary valve on different sides of a longitudinal center plane of the rotary valve; and a rotary valve housing having two gas openings provided in the common cross-sectional plane so as to face one another, each of said two gas openings being associated with one of said two gas ducts.

2. A rotary valve as defined in claim 1, wherein said two gas ducts are fresh gas ducts, and said two gas openings are fresh gas openings.

3. A rotary valve as defined in claim 1, wherein said two gas ducts are exhaust gas ducts, and said two gas openings are exhaust gas openings.

* * * * *